United States Patent [19]

Hackman

[11] 4,259,125

[45] Mar. 31, 1981

[54] PROCESS FOR MAKING LOW CARBON FIBERS

[75] Inventor: Lloyd E. Hackman, Worthington, Ohio

[73] Assignee: Ribbon Technology Corporation, Canal Winchester, Ohio

[21] Appl. No.: 43,126

[22] Filed: May 29, 1979

[51] Int. Cl.[3] ..... C21D 8/00

[52] U.S. Cl. ..... 148/3; 148/12 B; 164/423

[58] Field of Search ..... 148/3, 143, 156, 12 B; 164/423

[56] References Cited

U.S. PATENT DOCUMENTS

| | | | |
|---|---|---|---|
| 3,844,845 | 10/1974 | Livingston | 148/3 |
| 4,023,985 | 5/1977 | Dunkerley et al. | 148/3 |
| 4,066,474 | 1/1978 | Uchida et al. | 148/143 |

*Primary Examiner*—Howard S. Williams

*Attorney, Agent, or Firm*—Francis T. Kremblas, Jr.; Frank H. Foster

[57] ABSTRACT

An improved method for forming steel fibers from a process of the type in which the fiber is drawn directly from a pool of molten metals. The improvement revolves around the discovery of an alloy starting material which substantially reduces processing steps and equipment and produces a fiber with improved ductility and strength characteristics. The addition of controlled amounts of copper to a typical low carbon steel alloy provides a wider latitude in the necessary cooling steps to greatly facilitate the control of the ductility and strength of the final product through the use of low cost processing techniques.

4 Claims, 1 Drawing Figure

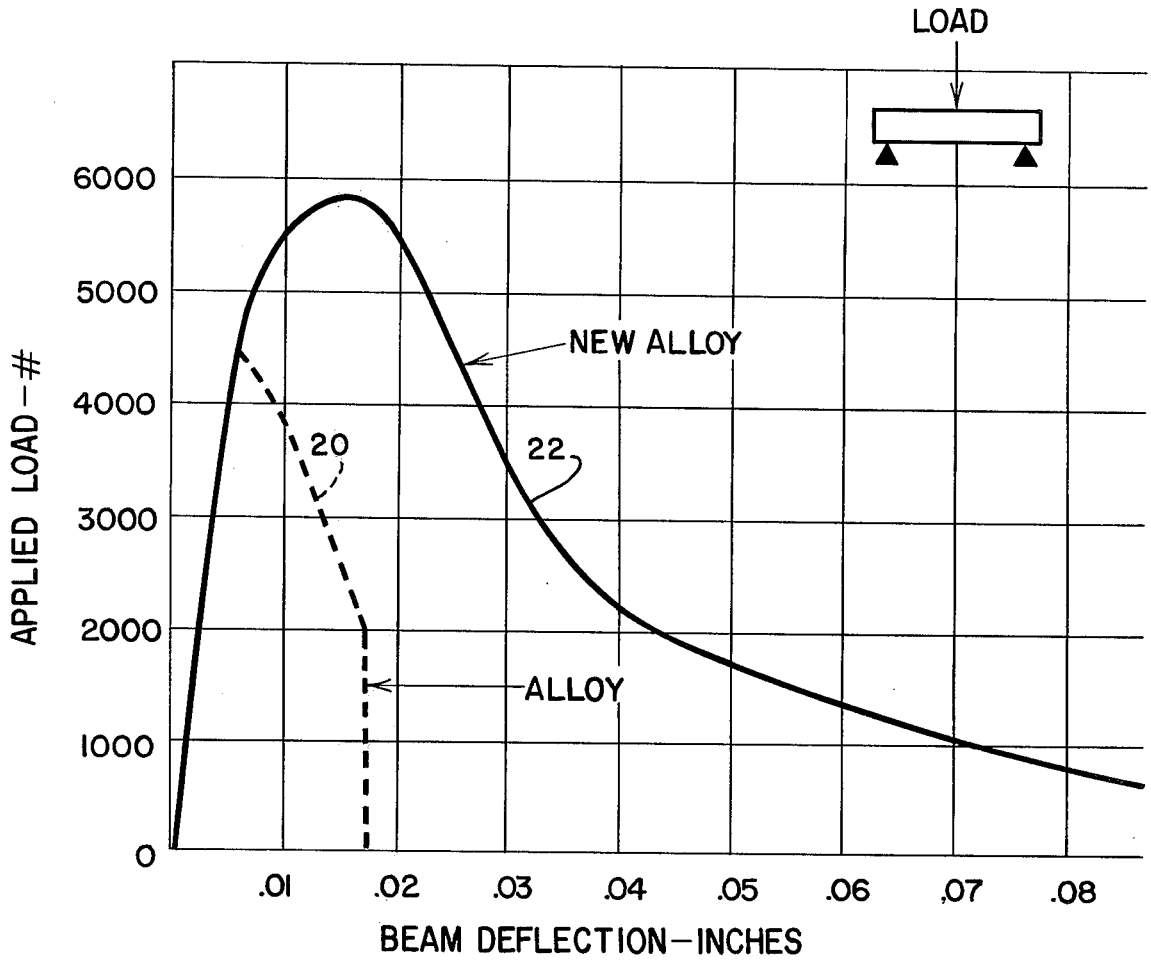
LOAD
6000
5000
4000
3000
2000
1000
0
APPLIED LOAD—#
NEW ALLOY
20
22
ALLOY
.01
.02
.03
.04
.05
.06
.07
.08
BEAM DEFLECTION—INCHES

PROCESS FOR MAKING LOW CARBON FIBERS

BACKGROUND

Production of low carbon steel wire from a direct melt low carbon alloy process has been known for many years. Fibers may be produced directly from a molten metal alloy stream impinged upon a chill block which is called melt spinning. Another well-known process which employs a rotating wheel or disk which contacts a pool of molten metal is referred to in the industry as melt extraction.

A particularly important application for fiber forming processes is the production of low cost steel fiber for use as a concrete reinforcing agent. One of the primary problems in producing such fiber is achieving the necessary ductility and strength in the final product while keeping the cost of manufacture at sufficiently low levels to be of commercial usefulness.

The melt extraction process is generally preferred for producing such low cost steel fibers compared to melt spinning.

In order to achieve sufficient ductility in this process, the cooling rates must be controlled properly to assure a quality product. Therefore, prior attempts to utilize this process have devised relatively elaborate quenching systems to attempt to obtain the necessary control of ductility in the fiber product. However, it has been a very difficult problem to obtain the necessary consistency of result using such systems. It appears that the typical low carbon steel available as scrap which is used in such processes for obvious economic necessity, is very critical to quench rates relative to obtaining the ductility required in the final product. In view of the necessity that low cost manufacture be maintained as well as low cost of raw material, this problem has been a major limiting factor in the efficient production of low carbon steel fiber from melt extraction which possesses the necessary levels of both strength and ductility for concrete reinforcing applications.

SUMMARY OF INVENTION

The present invention relates generally to the melt extraction process for forming steel fibers and particularly to an improved process utilizing an alloy composition which has been discovered to simplify the necessary processing steps and which also results in a product having vastly improved characteristics of strength and ductility.

It has been discovered that by changing the alloy composition typically employed in such processes by primarily adjusting the amount of copper results in an alloy which is drammatically less sensitive to quenching conditions than prior alloys and more easily achieves the desired level of ductility and strength in the final fiber product.

Employing this alloy permits a more simple quenching system to be employed which also lends itself to low cost production on a large volume scale.

Tests conducted in concrete slabs reinforced with steel fiber produced in accordance with the present invention have shown a remarkable increase in desirable characteristics as compared to those reinforced with fibers produced in prior conventional melt extraction methods.

IN THE DRAWINGS

The FIGURE is a graphical representation of the improved strength characteristics of concrete reinforced with steel fibers produced according to the present invention as compared to a typical prior art fiber.

DETAILED DESCRIPTION

The present invention relates generally to steel fibers produced from the well-known melt extraction process and particularly to an improvement in such process which is characterized by employing an alloy which markedly simplifies the necessary processing steps and yields a drammactically improved fiber for concrete reinforcement application.

Prior to the present invention, it has been recognized that the melt extraction process potentially could provide a tremendous source of low carbon steel fibers for use in concrete reinforcing applications since scrap steel from many sources could be used for raw material.

Low cost steel fibers could be produced competitively against such other sources, such as conventionally drawn fiber or slit sheets, which are limited due to raw material costs.

However, for many years a major problem of low carbon steel fibers produced from melt extraction is the difficulty which has been experienced in achieving the necessary high levels in ductility and strength which are vital properties for the reinforcement of concrete.

In such reinforcing applications the fibers must be capable of bending as they are pulled across a concrete break interface. This fiber bending and pulling out at the break interface provides that concrete with ductility characteristics unobtainable with unreinforced concrete or concrete reinforced with relatively brittle fibers.

In view of the nature of this application, it has always been recognized that raw material must be essentially from scrap products if the product is to be of any economical usefulness. Additionally the production or processing costs must also be very low in order to compete in the market.

However, low-carbon steel alloys previously used in such processes have proven to be difficult to extract in acceptable fiber form and further have exhibited major processing difficulties relative to controlling the strength and ductility of the final product.

Attempts have been made to improve the ductility of the fibers by further processing steps involving improvements in the control of the cooling rate.

However, such steps have proved relatively unsatisfactory since they increase processing costs and additional improvement of ductility in the final product has been slight or too inconsistent to make a viable commercial product.

The present invention relates to the surprising discovery that drammatically improved results may be obtained by employing a low-carbon steel alloy in which the amount of copper in the alloy is controlled within certain predetermined limits.

Since additional copper can be quite easily added to the scrap stock material which forms the only practical raw material, this represents an economical method of providing this predetermined alloy.

By relatively simple analysis, even unknown alloys of low-carbon steel scrap material can be utilized by adjustment of the copper content within the predetermined range.

Further test results have determined that such an alloy is especially suitable for melt extraction and that it is comparatively easy to control the strength and ductility of the final fiber product.

It has been demonstrated that a low-carbon steel fiber can be produced directly from the melt extraction process which possesses the strength and ductility required for achieving remarkable increases in load-bearing in concrete reinforcement applications.

It has also been discovered that the cooling rates for such fibers produced from melt extraction are not as critical utilizing this alloy as compared to those priorly employed such that simple low cost techniques may be used to produce fibers of excellent quality.

In the present invention, the control of cooling rates is achieved by passing the hot wire fibers which leave the melt through a water spray mist. By merely controlling the amount of water such that the fiber leaves the water spray still in a slightly cherry red condition and then continuing the cooling in air down to room temperature, a well annealed and highly ductile fiber is achieved.

Experience has shown that the alloy of the present invention makes processing such a high quality fiber much easier and less costly than prior methods which were unsuccessful and more costly.

The alloy composition which has been discovered to yield such surprising results comprises the following weight percents:

| | |
|---|---|
| Carbon | 0.25% maximum |
| Manganese | 1% maximum |
| Silicon | 0.6% maximum |
| Copper | 0.3 to 0.75% maximum |
| Iron | balance |

Of course, other commonly occurring impurities and other elements in relatively small amounts do not appear to have disadvantageous results for the purposes of the present invention.

It should be noted that while copper is not an uncommon alloy in carbon steels it is very surprising and unexpected to discover that copper in this percentage range has such a stabilizing effect upon the criticality of the quenching conditions in a melt extraction type process relative to the improvement in the ductility of the final product.

The proof of the drammatically increased properties of the fiber are illustrated in the FIGURE wherein the applied load is shown versus the Beam Deflection in inches in a standard beam test.

Curve 20 represents the results using typical low-carbon alloy fibers in which the copper content was below 0.3%. Curve 22 represents the results using fibers produced according to the method of the present invention.

In each case the concrete beam was reinforced with the same nominal amount of fibers in a conventional manner.

It is readily apparent from FIG. 1 that curve 22 indicates that the beam exhibited unexpected improved strength characteristics. The ductility of the fibers is great enough to permit them to bend and pull out rather than breaking quickly at the break interface of the concrete such as is indicated in the prior art fibers by curve 20.

Even at a deflection of over 0.07 inches, curve 22 shows a supporting strength of over 1,000 pounds whereas curve 20 indicates no load bearing strength at a point before the interface break reaches less than 0.02 inches.

It is also drammatically illustrated that at this same point where curve 20 indicates zero load bearing strength, curve 22 indicates a load bearing strength of nearly 5,800 pounds which is near the maximum prior to a break occurring.

Improvement in such an application of reinforced concrete of this magnitude are surprising in and of itself, however, it is even more surprising that such results may be achieved by means such as a relatively simple to achieve alloy adjustment and relatively simple and inexpensive rate cooling steps.

In operation, the melt extraction process being well known will not be described in detail, however, as the fibers are produced from the melt by the rotating wheel or disk, they are typically thrown onto a conveyor or the like.

In the process of the present invention using the alloy described above, the conveyor loads directly to a region of controlled water mist which initiates the controlled quenching conditions. The extent of this controlled quenching zone is such to insure that the fibers leave the water mist when their temperature approaches 1,000 degrees F. but preferably has yet to drop below approximately 1,000 degrees F.

The quenching may be controlled quite satisfactorily by simple adjustment of the amount of water supplied to the zone through a series of several nozzles supplied with water and a gas at controlled pressure.

It is desirable to provide an inert atmosphere in the water mist quenching zone and beyond the mist portion to maintain a minimum of oxidation of the fibers until they reach a temperature close to room temperature.

Upon leaving the water mist zone, the fibers are allowed to cool relatively more slowly in this inert atmosphere from approximately 1,000 degrees F. to room temperature.

While an inert atmosphere is desirable to minimize oxidation, it is not necessary. Ambient room temperature and atmosphere works well since the alloy employed in the present invention appears to be much more resistant to rapid deterioration by oxidation than the priorly used low carbon steel alloys. It has been found that an acceptable method and apparatus to perform the slower cooling rate needed subsequent to the water spray mist may be accomplished by merely providing a hood structure through which the fibers are carried. The atmosphere is essentially atmospheric air and the temperature varies between close to ambient room temperature at the end of the hood structure and up to a couple of hundred degrees above room temperature within the forward portion of the hood. This higher temperature results from the heat generated by the hot fiber particles themselves as they pass through the hood.

Fibers produced by directly being exposed to room temperature to cool have been found to be satisfactory generally with only a relatively thin coating of oxide being formed.

It is critical to assure that the rate of cooling of the fibers is substantially reduced prior to the fibers reaching the critical annealing temperature which for most low carbon steel alloys is in the range of approximately 800 to 900 degrees F. Since low cost processing is essential to practical success, elaborate cooling systems and controls are much too costly. Therefore relatively simple procedures must be employed, yet a highly ductile fiber must be produced.

The water spray provides a convenient and inexpensive means to rapidly cool the fibers to a temperature just above the critical annealing temperature to shorten overall quenching time without interfering with the quality of the end product.

Further, prior to the discovery of the surprising effect of the amount of copper in the alloy melt, even more elaborate cooling systems failed to achieve reliable consistency in the ductility of the final product.

On the other hand, providing at least the minimum amount of copper as disclosed herein has permitted the use of simple exposure to air at ambient room temperatures to efficiently achieve the second cooling step at rates reduced sufficiently to produce highly acceptable ductility characterisitics in a consistently manner. By combining more rapid water mist cooling and cooling in a gaseous medium, a relatively quick, yet successful product can be obtained at a commercially competitive cost.

For example, employing alloys having less than 0.3 percent by weight of copper, the ductility of the final fiber product often was characterized by possessing less than approximately two percent elongation even using relatively more elaborate cooling procedures. The high percentage of such fibers in the product resulted in poor reinforcing characteristics as shown in the FIGURE.

However, employing the teachings of the present invention, fiber products tested showed remarkably consistent percentages of elongation greater than eight percent. This represents a drammatic fourfold increase over the prior art teachings and such fibers prove to be drammatically superior in their intended application for concrete reinforcement as illustrated in the FIGURE.

It should be pointed out that in attempting to utilize the low cost melt extraction process to convert relatively inexpensive scrap into useful steel fibers, the control of quench conditions simply cannot require elaborate equipment or long-time consuming process steps. If such is necessary the cost of manufacture quickly outpaces the saving to be realized in using low cost scrap as a source of raw starting material.

Therefore, prior to the present invention, only more expensive stainless steel scrap has been utilized for concrete reinforcing applications since control of quenching conditions did not pose the serious problems presented by the more readily available low-carbon steels relating to the strength and ductility of the final product.

Quite clearly then, the full potential of melt extraction production of low cost low-carbon steel fibers could not be satisfactorily realized unless the difficult control of ductility and strength could be solved in an economical manner.

The present invention provides just such a solution. Since the primary solution revolves around controlling the copper content in low carbon steels, this alloy composition control is relatively easy to accomplish by appropriate addition of copper to the various scrap steels.

Generally, this may be accomplished by simple addition of copper to the melt furnace utilized in the melt extraction process to assure the copper content of the melt is within the range of between approximately 0.3 to approximately 0.75 weight percent.

Alloys having less than approximately 0.3 weight percent of copper do not appear to exhibit any significant improvement in the desired quality of the fibers. Higher percentages of copper above the noted range do not appear to increase the desired qualities in any amount which justifies the additional cost thereof.

Since this alloy then exhibits such a greater tolerance to the quench conditions or cooling rate relative to achieving consistently high ductility in the final fiber product, simple quenching procedures, such as a water mist first cooling step followed by ambient air atmosphere cooling may be employed.

The use of the alloys including the percentage of copper noted herein also improved resistance to atmospheric corrosion which is not only advantageous in the end product but greatly improves the capability of the alloy to be melt extracted. Therefore the alloys employed in the present invention have been much easier to melt extract than the low-carbon steels that have been employed in prior attempts to produce fibers of this nature.

In the water spray system the nozzles are so arranged to provide a fine mist spray to cover the trajectory of the fiber as they are thrown from the extraction wheel. The mist is created by air injected into the nozzle under pressure to atomize the water. Maintaining the air pressure, the water can be adjusted to provide the specific amount of water necessary. Several groups of nozzles are also used to provide even greater control on the quantity of water applied. The nozzles are arranged in pairs in such a manner as to provide the spray at intervals along the fiber trajectory. By turning off or reducing the output of water in the various groups, control of the cooling rates can be achieved. It has been found that from 6 to 12 nozzles and an air pressure between approximately 30 to 60 psi have worked successfully in obtaining desirable results.

The water mist must be atomized to prevent the case of a water droplet directly inpinging upon the fine fiber and causing a local quenching or brittleness of the fiber. The atomized mist cools the fiber more evenly.

It should also be pointed out that the carbon content of the alloy in such a low-carbon steel process is purposely kept as low as possible to aid in achieving the higher ductility desired in the end product. However, if the carbon content is too low one will note that the trajectory of the fibers from the extraction wheel becomes higher due to the tendency of the fibers to adhere too long to the wheel. The operator can control this by simply adding small amounts of carbon to the surface of the melt bath. Through experience, the trajectory provides a convenient monitor to control this potential problem.

In view of the foregoing description it should now be apparent that a low cost commercially useful low-carbon steel fiber may be produced using melt extraction technology which has not been accomplished prior to the present invention.

What is claimed is:

1. A method for forming steel fibers using a melt extraction process comprising, in combination, the steps of forming a molten metal pool comprising essentially low carbon steel alloys and an amount of copper sufficient to raise the overall copper content of said alloy pool to at least 0.30 percent by weight of the melt; melt extracting steel fibers from said molten pool; exposing the steel fibers formed from said pool to a controlled water spray for a predetermined time period to cool said fibers to a temperature approaching their critical annealing temperature; removing said fibers from said water spray at a temperature above their critical annealing temperature and introducing said fibers to an ambient air atmosphere at a temperature significantly below the critical annealing temperature of said fibers until annealing is completed.

2. A method for forming steel fibers using a melt extraction process comprising, in combination, the steps of forming a molten metal pool comprising essentially low carbon steel alloys and an amount of copper sufficient to raise the overall copper content of said alloy pool to at least 0.30 percent by weight of the melt; melt extracting steel fibers from said molten pool; exposing the steel fibers formed from said pool to a controlled water spray for a predetermined time period to cool said fibers to a temperature approaching their critical annealing temperature; removing said fibers from said water spray at a temperature above their critical annealing temperature and introducing said fibers to an inert atmosphere at a temperature significantly below the critical annealing temperature of said fibers until annealing is completed.

3. In a melt extraction method for producing steel fibers, the steps of forming a pool of molten metal comprising essentially low carbon steel alloys having a carbon content less than approximately 0.25 percent by weight and a copper content greater than approximately 0.30 percent by weight, melt extracting fibers from said pool; cooling said fibers by passing the fibers produced from said pool through a first cooling zone which cools the fibers to a temperature no less than approximately 1,000 degrees F.; then removing said fibers from said first cooling zone while still at a temperature of 1,000 degrees F. or greater and then subjecting said fibers to a second cooling step at ambient room temperature until annealing of said fibers is substantially completed.

4. A method of forming steel fibers employing melt extraction techniques comprising, in combination, the steps of forming a pool of molten metal consisting essentially of a steel alloy having a carbon content less than approximately 0.25 percent by weight and a copper content greater than approximately 0.30 percent by weight; forming steel fibers from said alloy pool by melt extraction; cooling the fibers so formed by subjecting them to a first cooling step wherein said fibers are contacted by a water mist; removing said fibers from said first cooling zone prior to the fibers reaching the critical annealing temperature of the alloy forming said molten pool and moving said fibers to a second cooling zone wherein said fibers are exposed to a gaseous atmosphere at temperatures below the critical annealing temperatures until annealing is substantially complete.

* * * * *